US008082614B2

(12) United States Patent
Nour

(10) Patent No.: US 8,082,614 B2
(45) Date of Patent: Dec. 27, 2011

(54) ANTI SUFFOCATION INCLINED SLEEP AID FOR INFANTS WITH REFLUX OR VOMITING

(76) Inventor: Said Ibrahim Nour, Aurora, IL (US)

( * ) Notice: Subject to any disclaimer, the term of this patent is extended or adjusted under 35 U.S.C. 154(b) by 68 days.

(21) Appl. No.: 12/507,072

(22) Filed: Jul. 22, 2009

(65) Prior Publication Data

US 2010/0287706 A1 Nov. 18, 2010

Related U.S. Application Data

(60) Provisional application No. 61/084,019, filed on Jul. 28, 2008.

(51) Int. Cl.
*A47D 7/01* (2006.01)

(52) U.S. Cl. ..... 5/655; 5/633; 5/725; 5/731; 5/638

(58) Field of Classification Search ..... 5/655, 633, 5/638, 724, 725, 731, 733
See application file for complete search history.

(56) References Cited

U.S. PATENT DOCUMENTS

| | | | | |
|---|---|---|---|---|
| 3,315,282 | A * | 4/1967 | Lowery et al. | 5/638 |
| 3,403,413 | A * | 10/1968 | Calhoun et al. | 5/638 |
| 3,808,615 | A * | 5/1974 | Geary | 5/622 |
| 5,439,008 | A * | 8/1995 | Bowman | 128/875 |
| 5,697,113 | A * | 12/1997 | Shatz et al. | 5/655 |
| 7,003,831 | B1 * | 2/2006 | Goutevenier-Reyher | 5/655 |
| 7,251,846 | B1 * | 8/2007 | Elkin et al. | 5/655 |
| 7,752,691 | B2 * | 7/2010 | Bensoussan | 5/655 |

* cited by examiner

*Primary Examiner* — Michael Trettel

(57) ABSTRACT

An infant sleep aid device for alleviating acid reflux symptoms, preventing suffocation and collecting spit up or vomit is disclosed. The device includes a wedge-shaped body with a substantially flat incline to receive and support the infant in a prone or supine position. In addition the infant sleep aid includes section to support the torso of the infant and a section to support the head of the infant. The head support section is uniquely devised to include a wire mesh cloth sufficiently tensioned to support the head of the infant and through which spit up and vomit can drain through down to a funnel shaped body attached thereto or placed underneath; and means for delivering fresh breathing air through holes on the sides of the support head section. The infant sleep aid also includes primary and secondary harnesses to support and secure the infant in either prone or supine position.

13 Claims, 14 Drawing Sheets

ANTI SUFFOCATION INCLINED SLEEP AID FOR INFANTS WITH REFLUX OR VOMITING

CROSS-REFERENCE TO RELATED APPLICATIONS

This application claims the benefit of U.S. provisional patent application No. 61/084,019, filed Jul. 28, 2008 by the present inventor, which is hereby incorporated by reference in its entirety.

FEDERALLY SPONSORED RESEARCH OR DEVELOPMENT

Not Applicable

SEQUENCE LISTING OR PROGRAM

Not Applicable

BACKGROUND OF THE INVENTION

1. Technical Field of the Invention

This invention relates to an infant sleep aid device. In particular, it relates to a device for supporting an infant upright at angle while providing an unobstructed breathing airway under the infant's head and a means for capturing infant spit ups or vomits.

2. Description of Related Art

It is well documented that almost half of newborns develop acid reflux within weeks of birth. Whether it is a normal Gastric Reflux (GER) or the more serious Gastroesophageal Reflux Disease (GERD), infant reflux is a common condition which involves a back flow of acid from the stomach into the esophagus. A ring of muscles at the bottom of the esophagus called the lower esophageal sphincter (LES) opens and closes to allow food to enter the stomach. The LES opens to release gas after meals. More than gas may escape, however. The LES may also allow stomach contents to flow back into the esophagus and out through the mouth. Parents often see the result as spitting up, though vomiting may also occur. Reflux can occur at times other than during or shortly after a feeding. Reflux can also occur when babies cough, cry, or strain. The Reflux can create an irritation or even a damage of the sensitive inside lining of the esophagus. An uncomfortable, sometimes painful, burning sensation behind the breastbone is the common symptom described as heartburn. Other common symptoms of infant acid reflux include frequent spitting up or vomiting, irritability when feeding, refusing food or eating small amounts, sudden crying or constant crying, arching the back, and other known symptoms. Besides the discomfort and pain created by this condition for the infant, it is heart-breaking experience for the parents.

In order to reduce regurgitation and therefore reflux action, it is often recommended to feed the infant in an upright position and put the infant down after feeding on an incline surface of at least thirty degrees. Although there is a general trend to let infants sleep on their back due to risk of Sudden Infant Death Syndrome (SIDS), it is not uncommon for pediatricians to allow the infant to be positioned on his/her stomach with supervision for cases of severe GERD. Placing the infant on an incline is therefore commonly achieved by using a wedge-shaped body or simply a "wedge" made of sturdy foam which has an inclined surface on which to rest the baby. Some wedges have a small angle of inclination so that the infant does not need to be supported against sliding. Other wedges, with larger angle of inclination, require a harness or sling to prevent the infant from sliding down.

Although the industry's current available wedges serve their purpose of holding the infant at an angle to reduce the reflux action, they may not eliminate GERD altogether and certainly do not solve other problems or concerns faced by the parents. In particular one such problem and concern consists of air ways blockage if the infant moves his/her head and places his/her face directly against the wedge surface while in prone position (i.e. on his/her stomach). This is a potentially fatal situation as the infant will not be able to breath. Another concern for the parents is the inability to quantify or even estimate how much the infant has spit up or vomit.

Therefore, it would be a distinct advantage to have a device and a method to not only hold the infant at an angle comfortably on a wedge in either a supine or prone position using a harness or similar means but also provide an unobstructed breathing space regardless of the position of the infant's head on the supporting surface. Such device and method will also include the means to capture and collect spit ups and/or vomits for the purpose of quantifying and monitoring its odor, color and acidity. It is an object of the present invention to provide such a device and method to benefit not only infants with acid reflux but also with any infant that spit ups or vomits.

BRIEF SUMMARY OF THE INVENTION

An object of the present invention is to provide an infant sleep aid that allows the infant to be laid down safely and securely in an inclined position so that the infant's head is elevated with respect to his/her torso.

Another object of the present invention is to provide an infant sleep aid that has a firm surface to support the infant's torso and an adjoining wire mesh cloth to support the infant's head.

Yet another object of the present invention is to provide an infant sleep aid that has an open space directly below the wire mesh cloth supporting the infant's head and that will receive a funnel-shaped element to capture and channel any spit up or vomit to a receiving body connected to the bottom of the funnel or placed below said funnel.

A still further object of the present invention is to provide an infant sleep aid that has an open space directly below the wire mesh cloth supporting the infant's head and that has an unobstructed breathing air flow from underneath regardless of the infant's position on the wire mesh cloth.

Another object of the present invention is to provide an infant sleep aid that has a primary support blanket or sling attached or fitted over the infant's head section and that has an opening for the infant's head to rest directly on the soft wire mesh cloth below and that can safely hold the infant in place in both the prone and supine position.

Yet another object of the present invention is to provide an infant sleep aid that has a secondary support harness that is attached to the primary support blanket or sling and that receives and holds the infant in prone position.

A still further object of the present invention is to provide an infant sleep aid that has a secondary support wrap-swaddle combination that is attached to the primary support blanket or sling and that receives and holds the infant in supine position.

According to the present invention, then, an infant sleep aid is provided that is adapted to elevate the infant's head with respect to his/her stomach as well as to collect, monitor and/or dispose of infant's spit ups or vomits while at the same time providing an unobstructed air flow passage all around the infant's head.

According to the present invention, then, an infant sleep aid is provided that incorporates several features with distinct functions that are described herein.

A first feature of the present invention is to provide a wedge-shaped main body that broadly includes a cushion portion to receive the infant's torso and a uniquely devised section to receive the infant's head. The main body has a bottom horizontal surface, two vertical surfaces on the right and left sides, a vertical front surface adjacent to the infant's head, an inclined upper surface and may or may not include a short vertical rear surface at the lower end of the wedge-shaped body. The acute angle of inclination of the upper surface with respect to the bottom horizontal surface is preferably in a range between about 15° and 45°. The main body may consist of two separate sections tightly joined together, namely a torso section and a head section, or may be a single casing with two compartments in which a first lower compartment receives a cushion, sturdy foam or similar in a closely fitted relationship and an upper compartment receives the head support wire mesh cloth tightly fitted and bridged over the top edges of the upper compartment as well as the vomit collector funnel attached therein. The funnel may have an integrally built-in graduated bottom portion which stores the vomit and can easily be drained, or may have a standard baby bottle cap built-in to the bottom tip of the funnel and to which a prior art standard baby bottle can be threaded thereto. The vertical front panel of the upper compartment may have an opening to access the interior to drain the spit up and/or vomit from the funnel or to remove the baby bottle. The front side access opening may or may not have a pivoting panel acting as a hinged door if a completely closed compartment is desired. Preferably an intermediate vertical panel separates the compartment receiving the torso cushion from the infant's head compartment but may be omitted without departing from the overall functionality of the wedge-shaped main body.

Another feature of the present invention is that the wire mesh cloth supporting the infant's head can be an independent panel on its own that releasably snaps onto or fits tightly over the sides of the head compartment and can be easily removed for cleaning. The funnel can also be an independent body that can be releasably fitted or otherwise attached so that it hangs from the head compartment sides and can be easily removed for cleaning. Preferably the vertical left, right and front panels adjacent to the infant head compartment have small holes that allow fresh air to flow into the interior of the head compartment. Preferably the funnel has small holes oriented downward on three sides so that air flows from the inside of the head compartment into the funnel and up to the infant's head through the wire mesh cloth.

Yet another feature of the present invention is that the infant is safely secured on the inclined surface of the main body with a primary support blanket that is configured and adapted to receive the infant in either prone or supine position. The primary support blanket can be of any suitable material safe for the infant. A first preference of the primary support blanket is of the same geometric shape as the inclined surface of the infant head compartment and is placed over thereto. The primary support blanket has a large opening with dimensions few inches smaller than the wire mesh cloth supporting the infant's head. Two straps at the two upper corners of the primary support blanket are attached to the front panel of the main body. The attachment can be hooks, snaps, knuckle, Velcro, or any suitable attachments. Two additional straps located at the lower two corners of the primary support blanket are attached to the left and right side panels of the main body. In this first preference then the primary support blanket provides a secure support of the infant at four points onto the main body. A second preference of the primary support blanket is that the blanket is of the same geometric shape as the main body head compartment. The head compartment of the main wedge-shaped body then receives the blanket in a closely fitted relationship. The blanket's shape of this second preference is then similar to an open box with five sides. A bottom side that fits over the bottom of the head compartment, two sides that closely fit over the main body head compartment left and right sides, a front side that fits closely over the front side of the main body and a top side that fits over the wire mesh cloth supporting the head of the infant. The blanket can be of any suitable material safe for a baby. The blanket has a large opening in the top inclined surface with dimensions few inches smaller than the wire mesh cloth supporting the infant's head. The blanket of the second preference has also an opening in the front side to access the interior of the head compartment. The blanket of this second preference has then elastic rubber and fits closely and tightly onto the head compartment the same way a cover sheet fits over a mattress. Both preferences of the primary support blanket has attachment point in the middle of the lower horizontal band bounding the large opening at the infant's shoulder or neck level. This attachment can be any releasable or permanent but suitable and safe configuration to receive the prone or supine position infant garments of the invention as described further down.

A still further feature of the present invention is that both preferences of the primary support blanket described above herein receive the infant support garment of the prone position. Preferably, the prone position garment is a harness that has two torso portions that wrap around the torso of the infant and with the upper side of each portion being just about below the infant's arm pit. Preferably, the prone position support harness has also two shoulder straps that are fitted over the infant's shoulders in an X-shape fashion. Preferably, the prone position support harness has also a bottom strap that fits between the infant's legs and supports his/her butt. The torso wraps, the shoulder straps and the bottom strap of this prone position support harness come together at about the infant's back when all fitted closely around the baby's body and have either Velcro or other suitable attachments to directly and securely support the infant. The prone position support harness can be any other suitable harness as long as it can be releasably attached to the primary support blanket just about below the infant's chest.

Another feature of the present invention is that both preferences of the primary support blanket described above herein receive the infant support garment of the supine position. Preferably the supine position support garment is a combination of wrap and swaddle. Preferably the swaddle is a sac with a neck opening, arm openings, a zipper and a closed bottom, and receives the infant's body directly. Preferably the wrap is placed directly below the swaddle at about the infant's shoulders or upper torso, and is permanently stitched to the swaddle so as to make the wrap-swaddle combination as one unit. The wrap-swaddle unit is then releasably or permanently attached to the primary support blanket. Preferably the wrap and swaddle are attached to each other with the help of a second connection at about the infant's lower back to provide for additional support.

BRIEF DESCRIPTION OF THE SEVERAL VIEWS OF DRAWING

The invention will be better understood and its numerous objects and advantages will become more apparent to those skilled in the art by reference to the following drawings, in conjunction with the accompanying specification, in which.

DETAILED DESCRIPTION OF THE INVENTION

Figure 1:
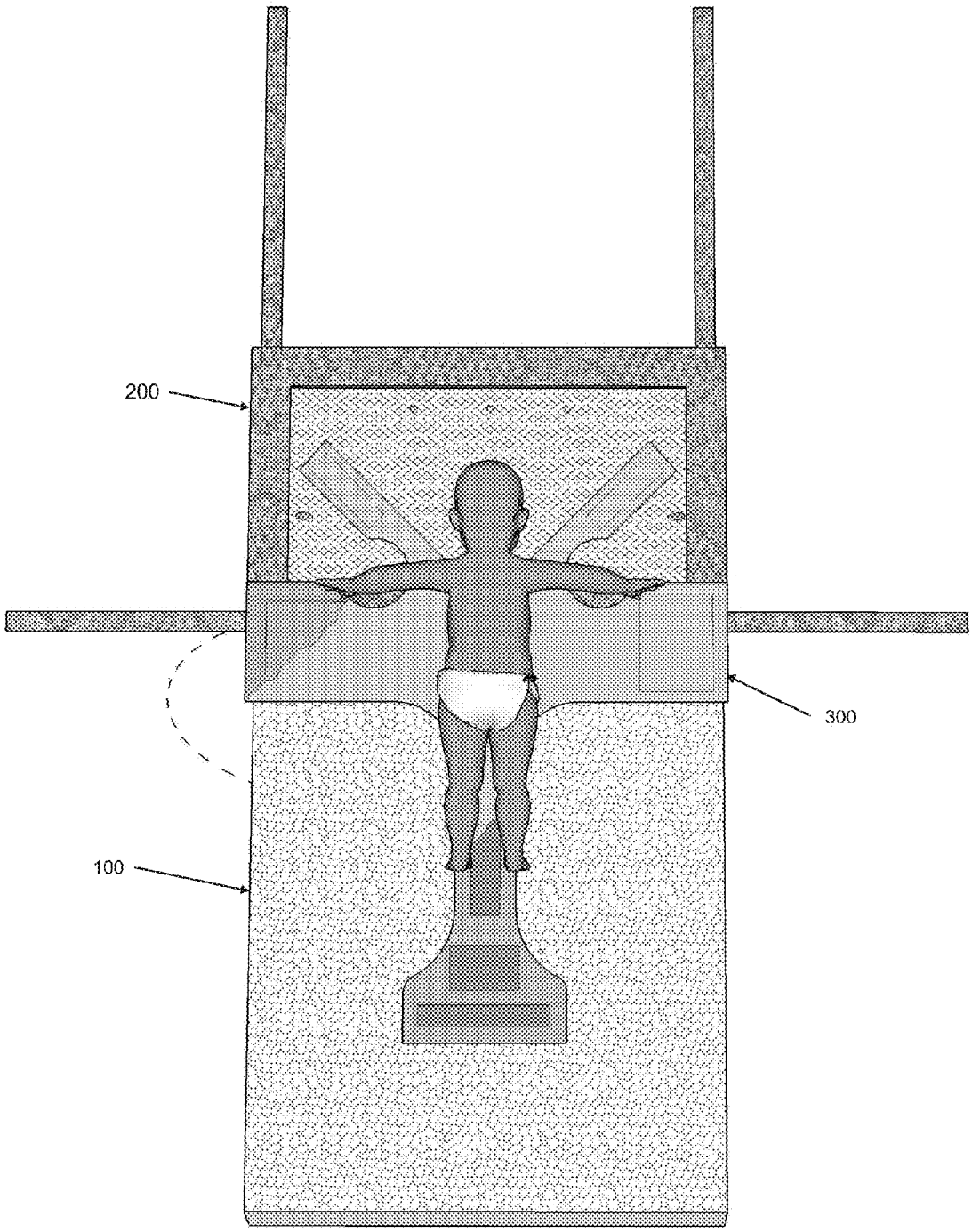
FIG. 1 is a plan view of the infant sleep aid showing the prone position preferred embodiment of the present invention.

Preferred embodiments of the invention are now described below with reference to various examples of how the invention can best be made and used. Like reference numerals are used throughout the description and several views of the drawings to indicate like or corresponding parts.

Referring now to FIG. 1, a plan view of the invention and its use for an infant's prone position is illustrated showing the main wedge-shaped body 100, the primary support blanket 200 with its large opening at the infant's head level and four attachment straps, and the prone position support harness 300 that directly receives the infant.

Figure 2:
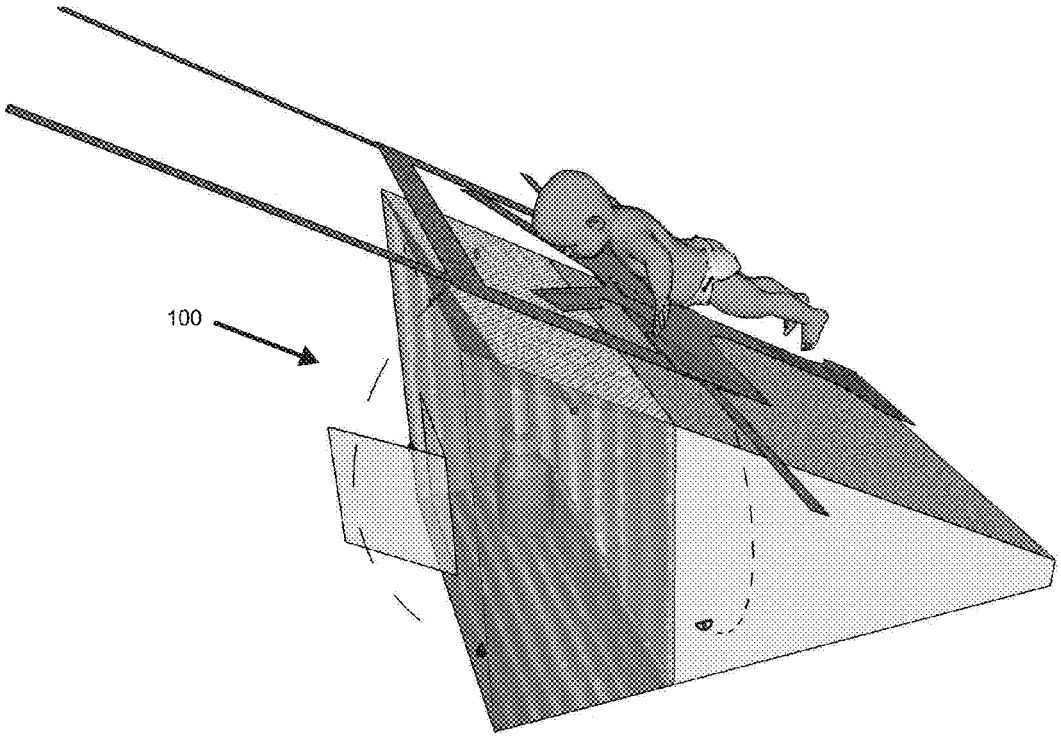
FIG. 2 is a perspective view of the infant sleep aid showing the infant prone position preferred embodiment of the present invention.

FIG. 2 further gives a clear perspective of the invention illustrating the prone position of the infant resting on the wedge-shaped main body 100 with two distinct sections, namely the torso section and the head section.

Figure 3:
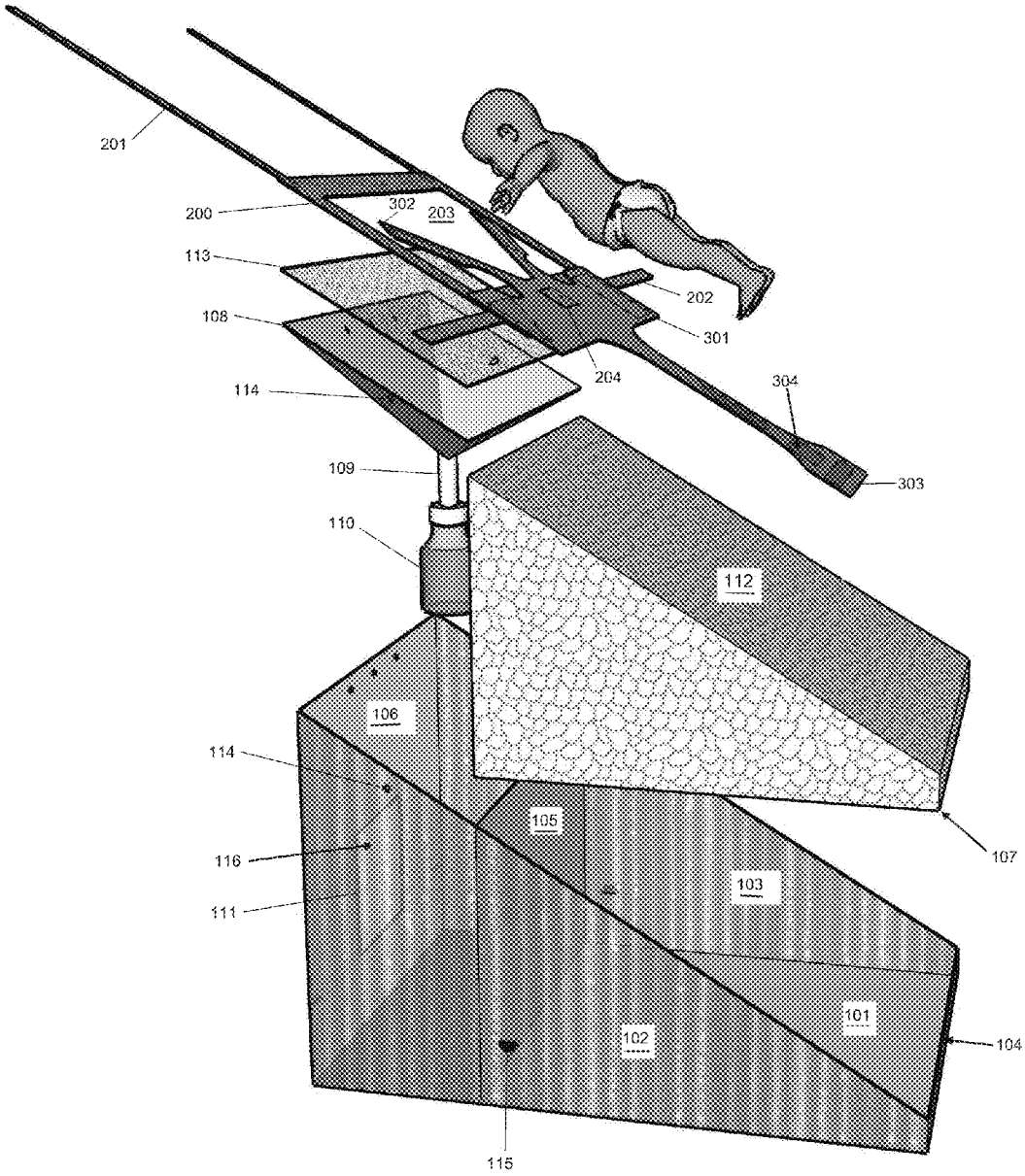
FIG. 3 is a perspective exploded view of the infant sleep aid showing the infant prone position preferred embodiment of the present invention.

FIG. 3 is a top exploded perspective view of an exemplary embodiment of the invention with the infant supported safely in a prone position. The wedge-shaped main body 100 consists of a bottom horizontal panel 101 covering the entire base of the invention. A left panel 102, a right panel 103, a front panel 106 and a rear panel 104 are attached to the bottom panel 101 to first create a wedge-shaped casing. The rear panel 104 may have a height varying from zero to few inches. An intermediate panel 105 is inserted in the casing to divide the main body into two distinct sections, namely the torso support compartment and the infant head support compartment. Ventilation holes 114 are drilled in the left panel 102 and right panel 103 adjacent to the head compartment. Similar ventilation holes 114 are drilled in the front panel 106 also. These ventilation holes provide fresh air flow from outside into the head compartment. An access opening 116 is made in the front panel 106. A pivoting panel (not shown here as it is optional) acting as a hinged door may or may not be attached to the front panel at the opening edge 111 to provide closed compartment if needed. Connection points 115 on the front, left and right panels receive straps 201 and 202 of the primary support blanket 200 to secure the infant to the main wedge-shaped body 100. A firm sturdy sleeping foam pad 107 made from any suitable material is then inserted into the torso compartment of the main wedge-shaped body 100. A cover sheet 112 is placed over the wedge-shaped cushion sleep pad 107 in a closely fitted relationship so as to provide a soft and safe sleeping surface for the infant. A funnel-shaped body 108 that is suitable to collect liquid or semi-liquid material is lowered into the head compartment and preferably fitted either on the upper inclined edges of left panel 102, right panel 103 and front panel 106 or otherwise connected to the inside faces of said panels so as to provide clearance from the edges. The funnel 108 can be of any suitable geometric shape and material as long as it provides its intended purpose of the present invention which is to collect and channel burp, spit ups and/or vomit of the infant. Ventilation holes 114 are drilled into the funnel 108 front, left and right sides to provide air flow from the inside or outside of the head compartment to the inside of the funnel. Preferably a circular short pipe 109 with a standard baby bottle cap attached thereto is connected to the bottom end of the funnel 108 to channel liquid or semi-liquid material to a receiver 110. A wire mesh cloth 113 receives directly the infant's head. The wire mesh cloth 113 can made from a textile fabric material that is safe for an infant's skin but is also impermeable and non-cohesive for the infant's burp, spit up and/or vomit to pass through and down to the funnel 108. The wire mesh cloth 113 can be directly attached to the edges of the funnel 106 or otherwise attached to the edges of the head compartment. The wire mesh cloth 113 is tightly attached to maintain a soft contact with the baby's skin but is also stretched and tensioned enough to support the weight of the infant's head without sagging.

FIG. 3 also shows how the primary support blanket 200 and the prone position support harness 300 fit over the main wedge-shaped body 100. The opening 203 in the primary support blanket allows the infant's head to rest directly on the wire mesh cloth 113. The primary support blanket 200 is attached to the main wedge-shaped body 100 with two straps 201 to the front panel 106 and two straps 202 to left and right panels 102 and 103. The primary support blanket 200 receives the prone position support harness 300 with attachment 204 which can be any suitable and releasable connection. The shoulder straps 302 are placed over the infant's shoulders from front to back in X-shape fashion. The torso wraps 301 are placed over the infant's torso just below the infant's arm pits. The bottom strap 303 is placed between the infant's legs and folded up to the back of the infant. Attachment 304 which can be Velcro or any other suitable but releasable connection is used to secure the infant to the prone position support harness 300.

Figure 4:
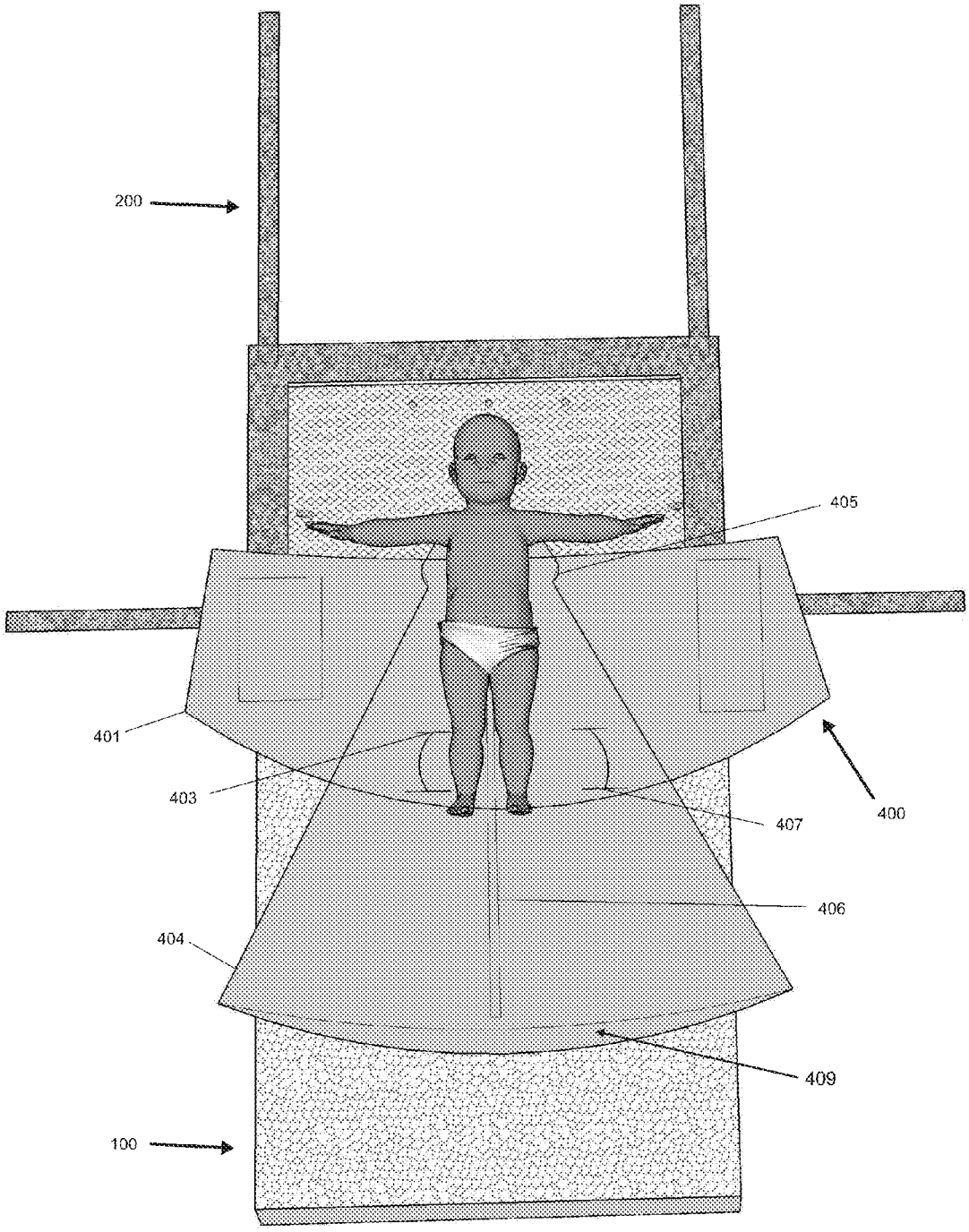
FIG. 4 is a plan view of the infant sleep aid showing the supine position preferred embodiment of the present invention.

Referring now to FIG. 4, a plan view of the invention and its use for an infant's supine position (i.e. on his/her back) is illustrated showing the main wedge-shaped body 100, the primary support blanket 200 with its large opening at the infant's head level and four attachment straps as well as the supine position support wrap-swaddle 400 that receives the infant directly.

Figure 5:
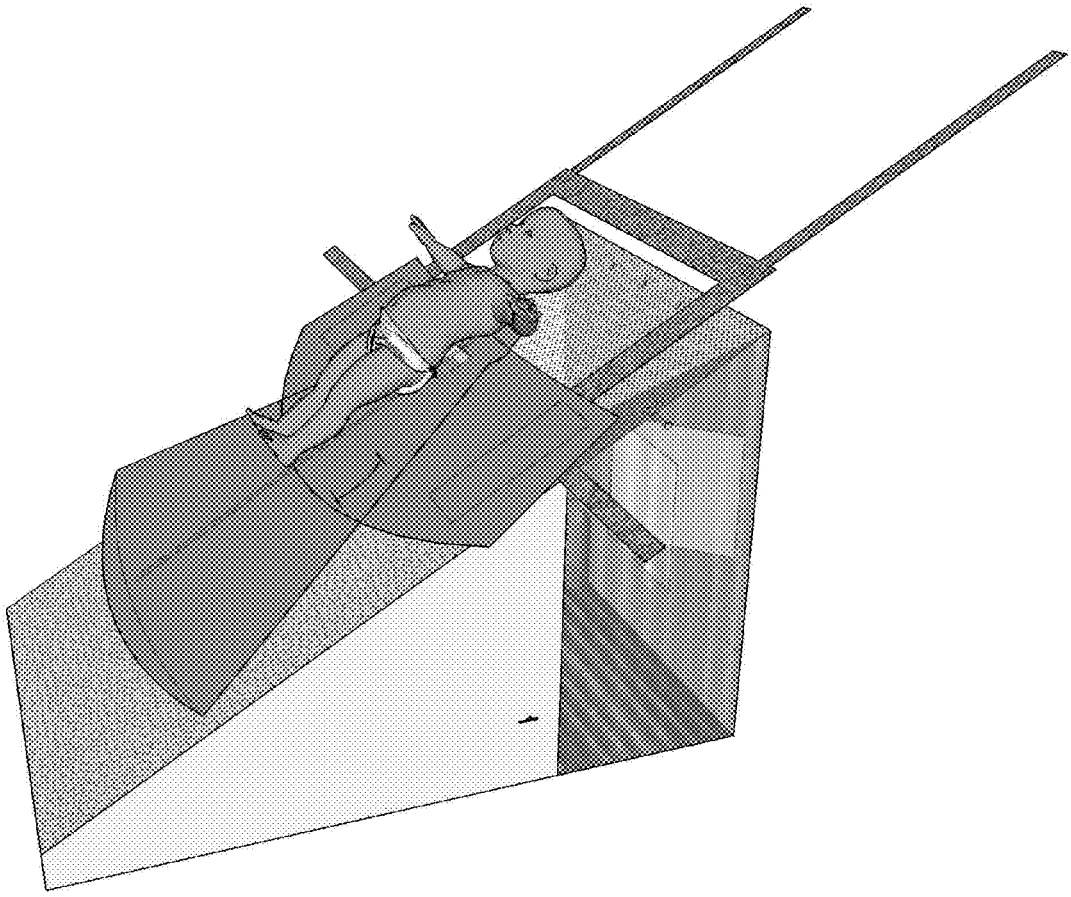
FIG. 5 is a perspective view of the infant sleep aid showing the infant supine position preferred embodiment of the present invention.

FIG. 5 further gives a clear perspective of the invention illustrating the infant resting on his back and secured with a wrap-swaddle on the main wedge-shaped body with two distinct sections, namely the torso section and the head section.

Figure 6:
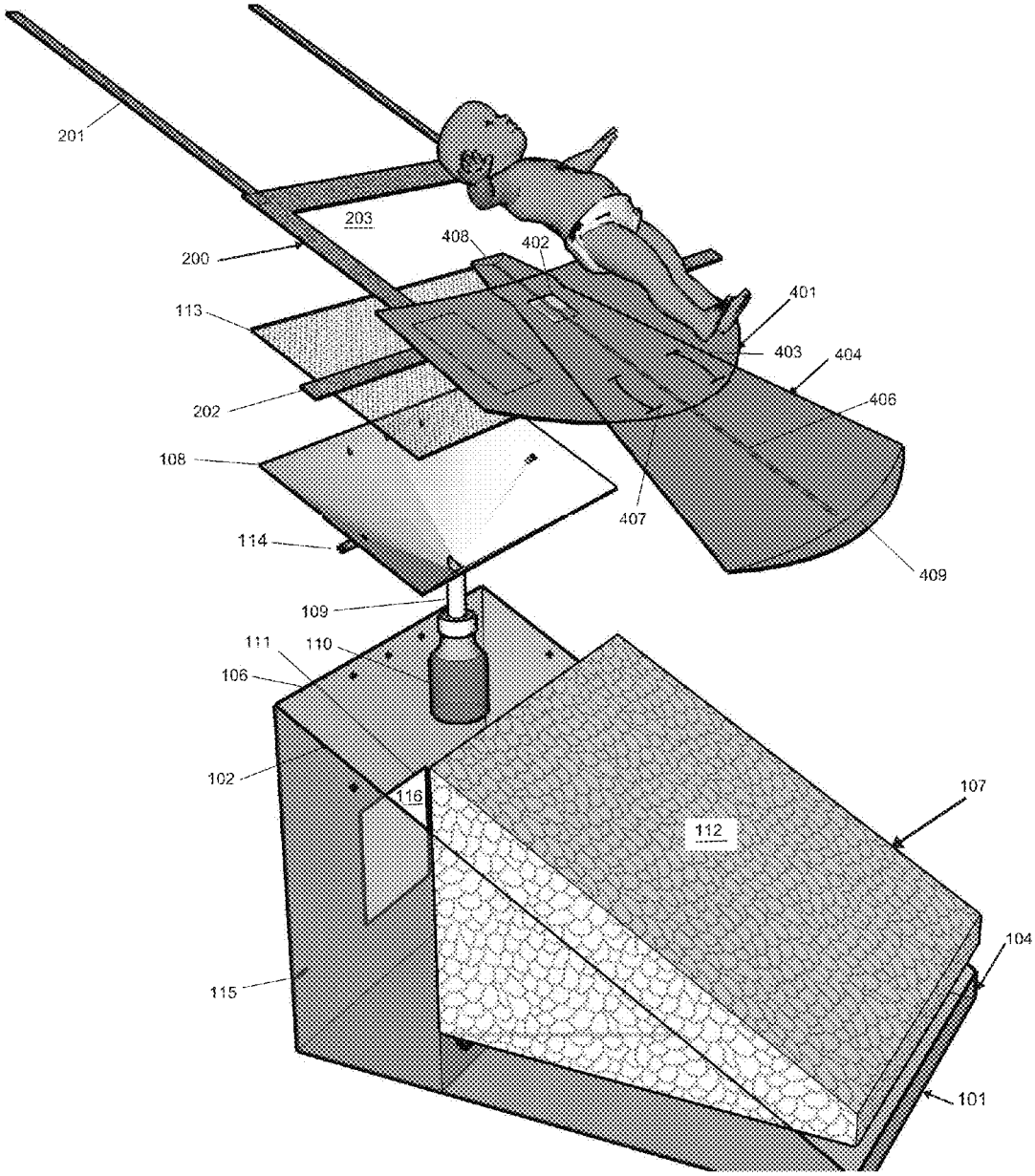
FIG. 6 is a exploded perspective view of the infant sleep aid showing the infant supine position preferred embodiments of the present invention.

FIG. 6 is a top exploded perspective view of an exemplary embodiment of the invention with the infant supported safely in a supine position. The main elements of the wedge-shaped body 100 were explained in the description of FIG. 3 and are not repeated here. The present invention is versatile enough that, to support the infant in a supine position, a combination of wrap-swaddle 400 is now connected to the primary support blanket 200 at the connection point 402. This connection can be any suitable but releasable attachment. We now focus on describing further the wrap and swaddle that secure the infant to the primary support blanket. The wrap and swaddle are made from two different elements that are stitched or connected together at the connection point 402. The wrap 401 is a flat fabric that is wrapped around the infant's shoulders once the baby is placed in the swaddle 404 to secure the infant in a swaddled fashion if desired. The wrap 401 is further attached to the swaddle at connections 403 and 407. The wrap and swaddle thus act as one unit to safely secure the infant to the primary support blanket 200 which, in turn, is secured to the main wedge-shaped body 100. Additional functionalities of the wrap-swaddle are provided in details later in the description of FIG. 10.

Figure 7:
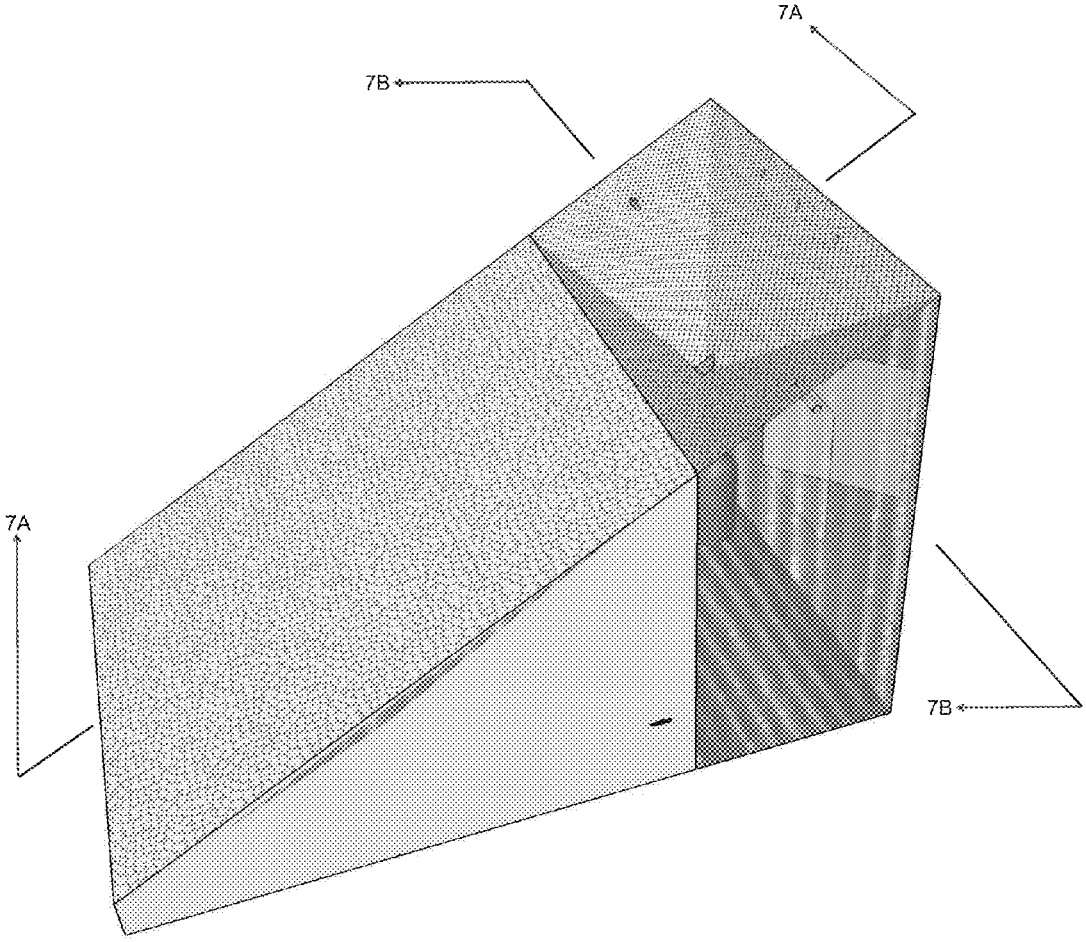
FIG. 7 is a perspective view of the infant sleep aid main wedge-shaped body 100 of the present invention.
Figure 7A:
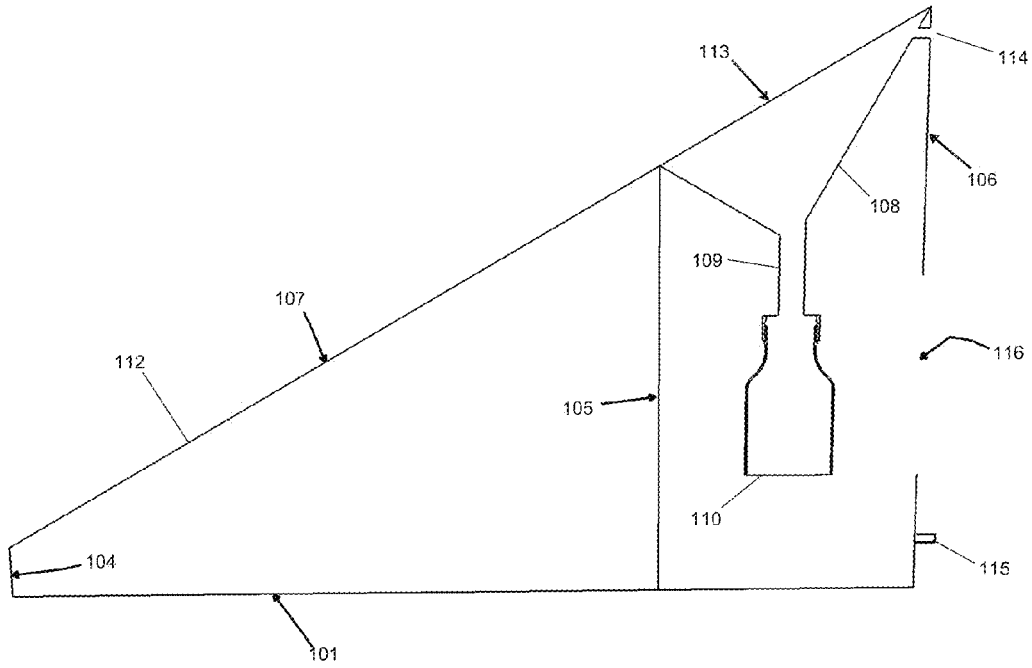
FIG. 7A is the infant sleep aid main wedge-shaped body 100 side view of section 7A of FIG. 7.
Figure 7B:
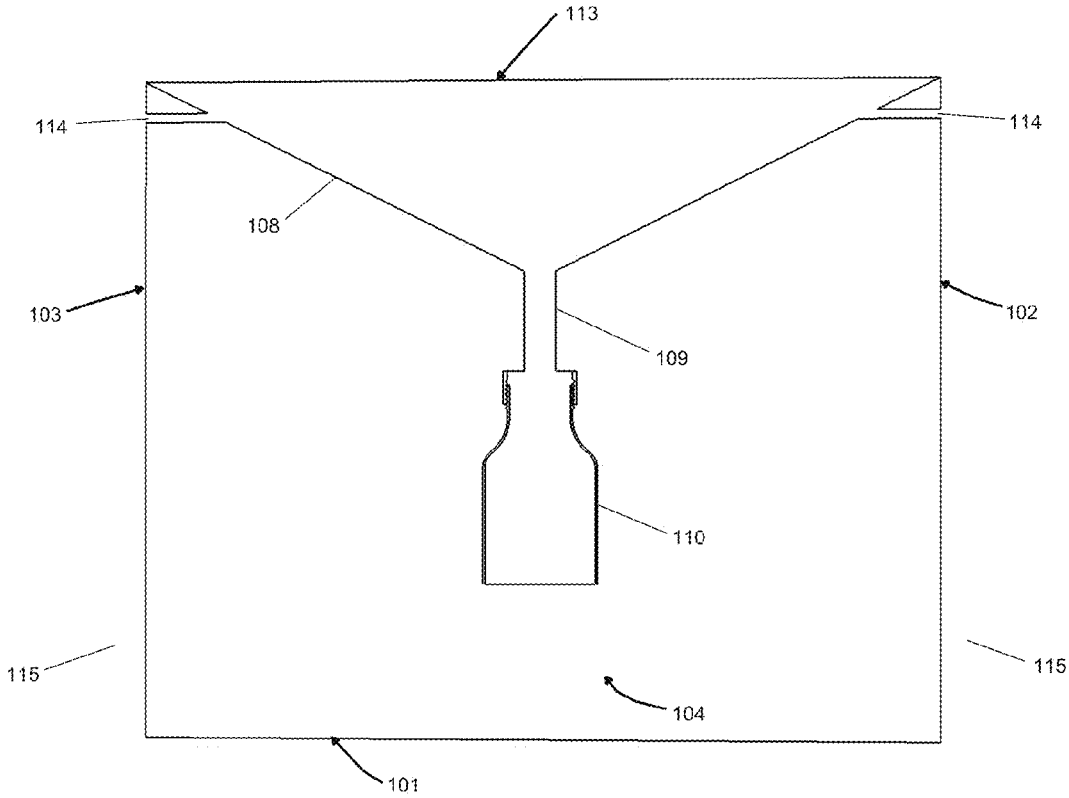
FIG. 7B is the infant sleep aid main wedge-shaped body 100 front view of section 7B of FIG. 7.

FIG. 7 illustrates a side perspective view of the present invention without the infant and infant support garments. A longitudinal section cut 7A-7A through the middle of the main wedge-shaped body 100 and a transverse section 7B-7B through the middle of the head compartment are now further described. FIG. 7A shows the cross-section 7A-7A of FIG. 7 depicting an even clearer view of the wedge-shaped main body 100 of the invention in a preferred exemplary embodiment. The bottom panel 101, the optional rear panel 104, the intermediate panel 105 and the front panel 106 with access opening 116 of the main body casing are illustrated. A ventilation hole 114 delivers air into the funnel 108 through the front panel. The wire mesh cloth 113 supporting the infant's head is leveled with the cushion 107 and cover sheet 112 supporting the infant's torso. The front straps of the primary support blanket are attached to the connection point 115 on the front panel 106. It is even easier to understand how the funnel 108 receives any burp, spit up and/or vomit from the infant's mouth and drain through an integral pipe 109 down to a receiving container 110 that is preferably a standard prior art baby bottle. In an alternate preferred embodiment, a graduated pipe 109 can be used as the receiving container and hence the infant baby bottle can be foregone. FIG. 7B now shows a front view in the transverse direction of the main wedge-shaped body of the invention. The bottom panel 101, the left panel 102, the right panel 103, the intermediate panel 105 are illustrated. The optional rear panel 104 is hidden and is shown with a dashed line. The wire mesh cloth 113 receives directly the infant's head and allows any burp, spit up and/or vomit from the infant's mouth to drop into the funnel 108 and down to the receiving container 110 through pipe 109. Ventilations holes 114 allow air to be delivered to the infant's head through the perforations in the wire mesh cloth 113. The side straps of the primary support blanket (not shown here) are secured to the wedge-shaped main body 100 at connection points 115 on the left panel 102 and right panel 103.

Figure 8:
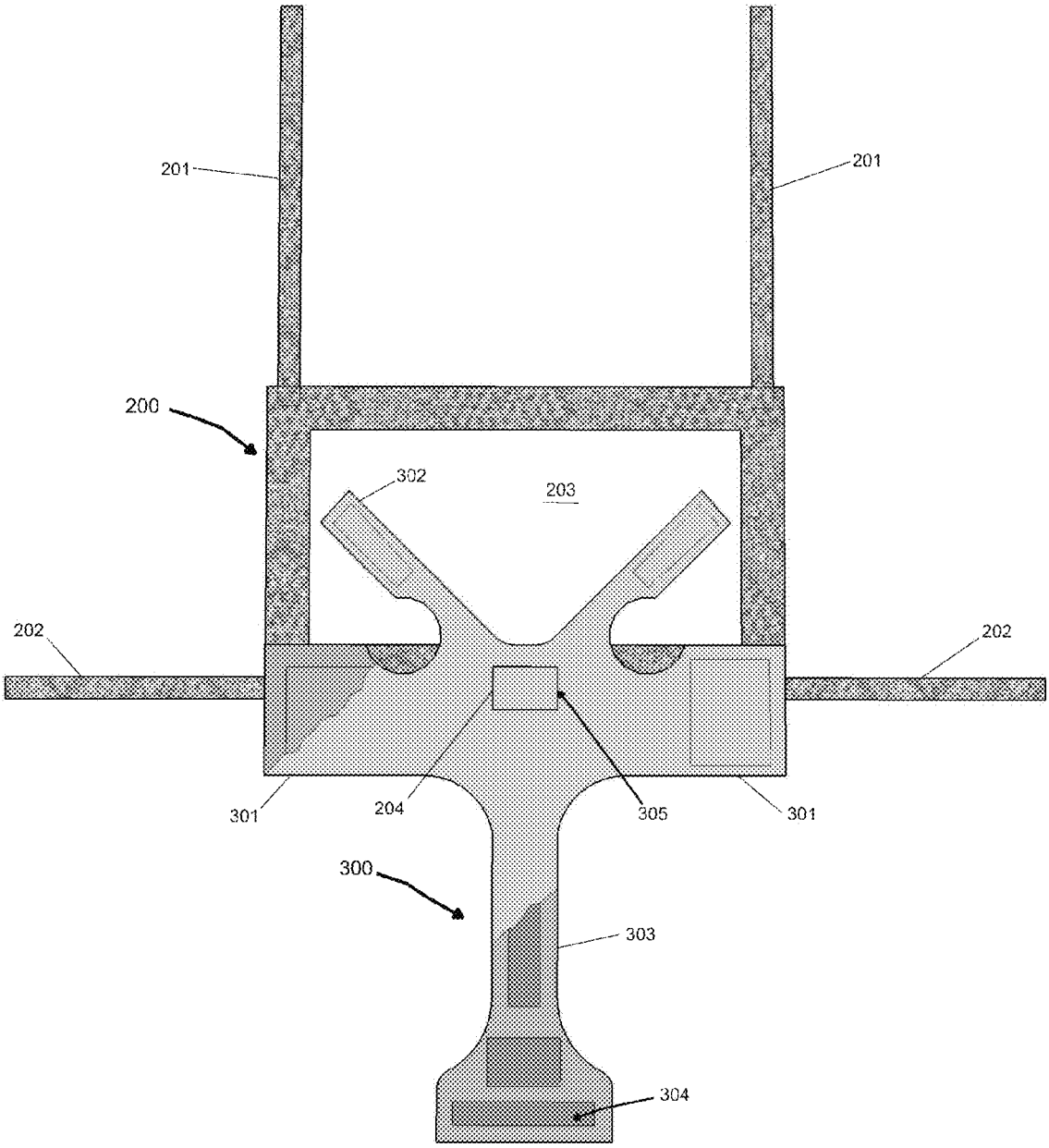
FIG. 8 is the top view of primary support blanket 200 and prone position support harness 300 in preferred embodiment of the present invention.

Turning now to FIG. 8, the exemplary embodiment that holds and secures the infant to the main wedge-shaped body in a prone position is explained in details. A primary support blanket 200 and a prone position support harness 300 are preferred to achieve this object of the invention. The primary support blanket 200 has an overall plan view geometric dimension to match and fit over the head compartment of the main wedge-shaped body 100. In addition, the primary support blanket 200 has a large opening taking up most of its surface and bound by four bands; one at the top, one at the bottom, one at the left side and one at the right side. Two connection straps 201 are used to attach the primary support blanket 200 to the main wedge-shaped body 100 at two connection points 115 on the front panel 106. Two more connection straps 202 are used to attach the primary support blanket 200 to the main wedge-shaped body 100 at two connection points 115 on the left panel 102 and right panel 103. The primary support blanket 200 is placed and attached to the main wedge-shaped body 100 in such a way that the large opening 203 is over the wire mesh cloth 113. The primary support blanket 200 then receives the prone position support harness 300 according to this preferred embodiment of the invention. The attachment of the prone position support harness 300 to the primary support blanket 200 can be releasable type attachments 204 and 305 or similar to allow the prone position support harness 300 to be detached if needed. The attachment of the prone position support harness 300 to the primary support blanket 200 can be also a permanent one. The infant then is placed on the prone position support harness 300 on his/her stomach so that the infant's head rests directly on the wire mesh cloth in such a way that his/her neck is between the shoulder straps 302 and his arms between the shoulder strap 302 and torso wrap 301. The torso wrap 302 is then wrapped around the infant's torso just below his/her arm pit. The shoulder straps 302 are then folded up over his/her shoulders in an X-shaped fashion. The shoulder straps 302 can have a Velcro on the back and attach to the torso wrap which also can have a Velcro type attachment on the back sides. A bottom strap 303 is placed between the infant's legs and wrapped up to his back so that it is attached to the torso wrap and shoulder straps. The infant is then safely secured to the prone position support harness which, in turn, is connected securely to the primary support blanket. The above described garments and method to secure the infant in a prone position is a preferred exemplary embodiment of the present invention. However, geometric variations, different types of attachments and different types of materials are possible without departing from the concept of the invention.

Figure 9:
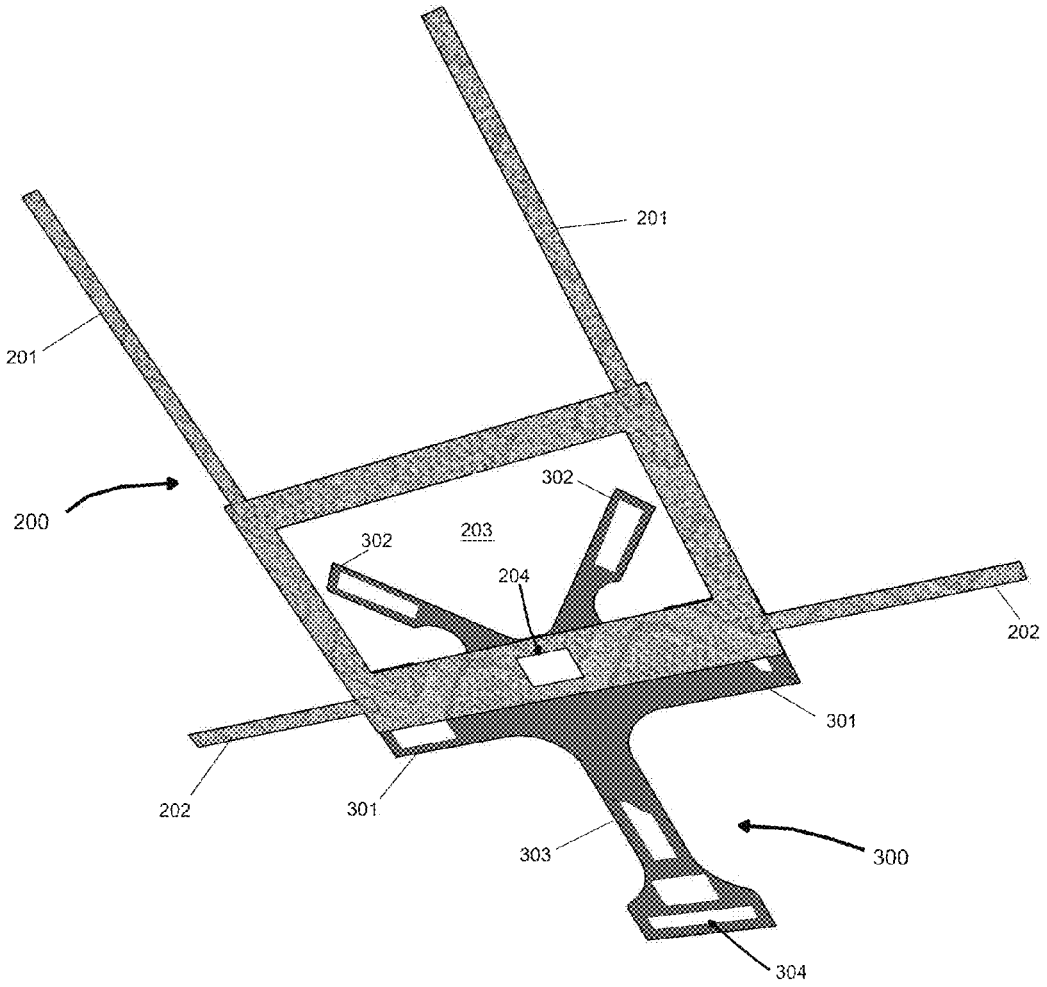
FIG. 9 is the bottom view of primary support blanket 200 and prone position support harness 300 in preferred embodiment of the present invention.

FIG. 9 shows the back side of the preferred embodiment of FIG. 8. In addition to the explanation provided previously, it is worth noting that it is clear now to see the support blanket attachment 204 which secures the prone position support harness 300 to the primary support blanket 200.

Figure 10:
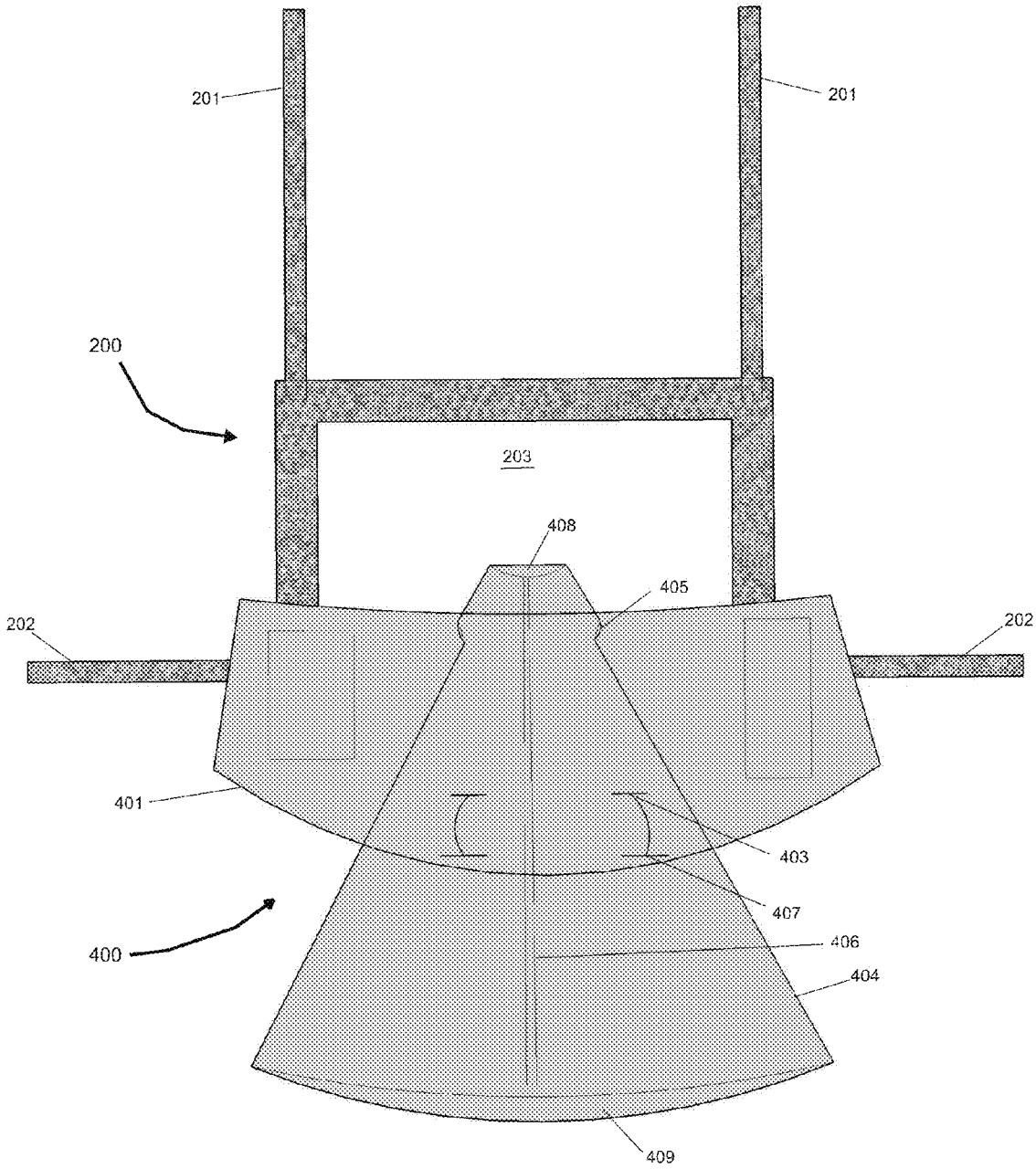
FIG. 10 is the top view of primary support blanket 200 and supine position support wrap-swaddle 400 in preferred embodiment of the present invention.

Turning now to FIG. 10, the exemplary embodiment that holds and secures the infant to the main wedge-shaped body 100 in a supine position is explained in details. A primary support blanket 200 and a supine position support wrap-swaddle combination 400 are preferred to achieve this object of the invention. The primary support blanket 200 details and its functionalities were explained in previous sections above and are not repeated here. The focus is now on the wrap-swaddle combination 400 and how it holds safely and securely the infant in a supine position. Preferably the wrap 401 and swaddle 404 are permanently stitched together at about the middle of the bottom band bounding the primary support blanket opening. The wrap 401 and swaddle 404 then become a wrap-swaddle combination 400 that receives and holds the infant safely and securely in a supine position. In addition, two small releasable connections 403 and 407 secure the swaddle 404 to the wrap 401 and maintain the two elements to act as one. In the preferred embodiment of the invention, then, the infant is placed on his/her back inside the swaddle sac 404 through the zipper 406. The swaddle infant neck opening 406 fits around the infant's neck and the infant's arm is fitted through the swaddle arm openings 405. The swaddle has a closed bottom side 409 thus making it act like a sac. If desired by the infant care-taker, the wrap 401 is then wrapped around the infant's shoulders to create a comfortable swaddled position.

Figure 11:
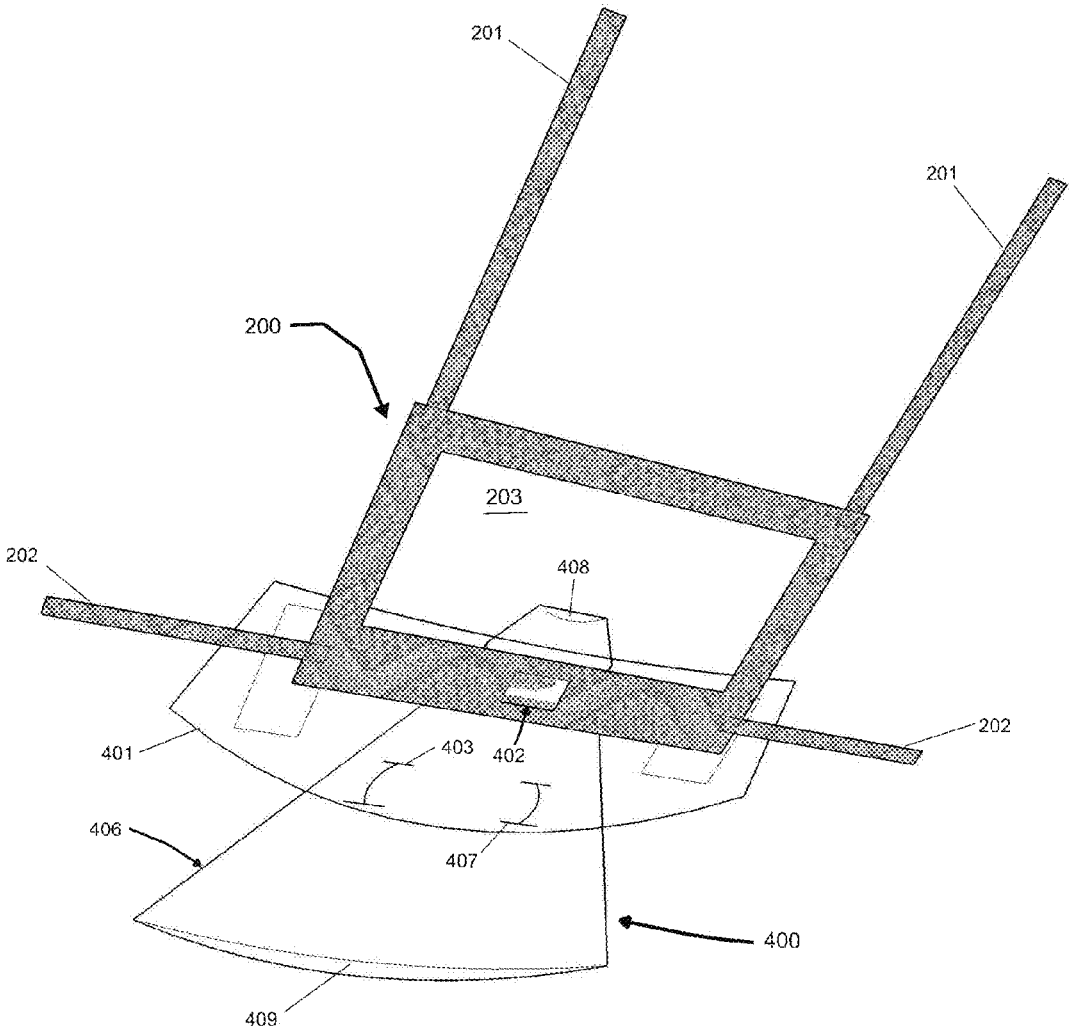
FIG. 11 is the bottom view of primary support blanket 200 and supine position support wrap-swaddle 400 in preferred embodiment of the present invention.

FIG. 11 shows the back side of the primary support blanket 200 with the wrap-swaddle 400 attached thereto. It is now clear to see that the wrap 401 and swaddle 404 are stitched at connection point 402 which can also be used to secure the wrap-swaddle to the primary support blanket 200.

Figure 12:
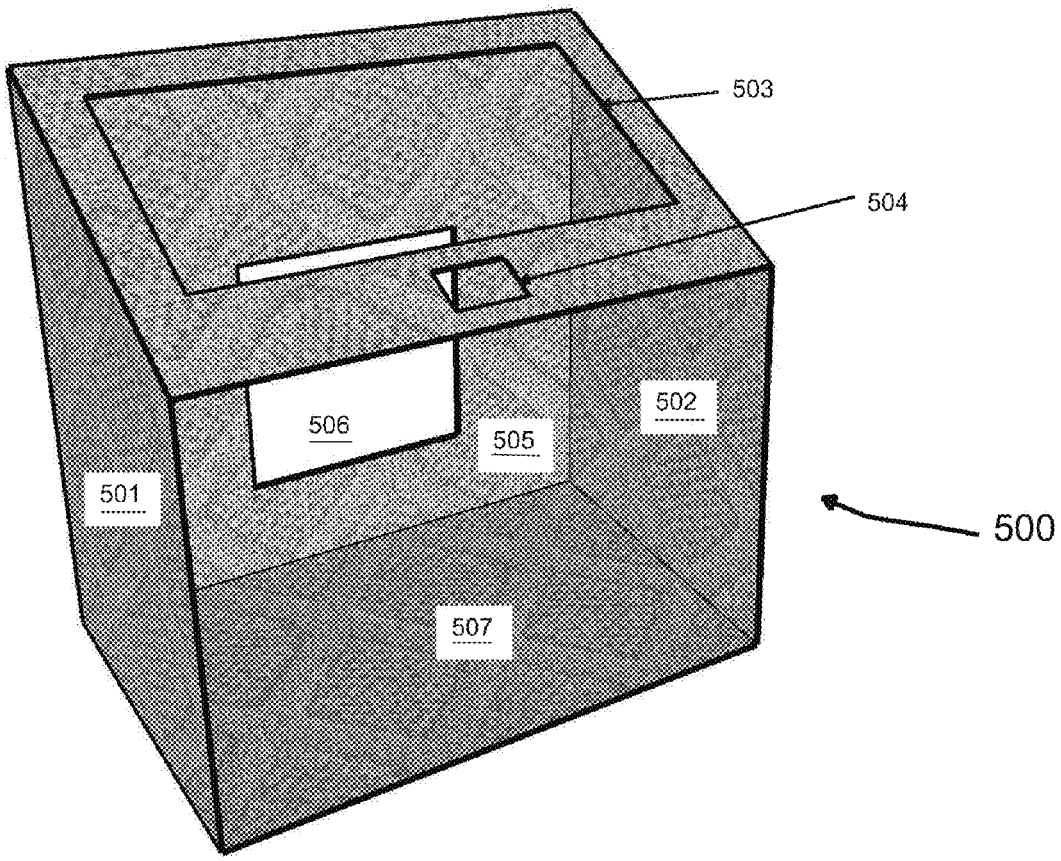
FIG. 12 is an alternate embodiment of the present invention for the primary support blanket.

FIG. 12 shows an alternate preferred embodiment for the primary support blanket 200. Instead of using straps 201 and 202 to secure the primary support blanket 200 to the main wedge-shaped body 100 as explained in the exemplary embodiment described above, an alternate preferred embodiment of the invention can be a box-shaped body that is placed over and all around the head compartment in a closely fitted relationship. This alternate embodiment provides the same functionality of the previously described primary support blanket 200 in that it receives the prone position support harness 300 or the supine wrap-swaddle 400 at the connection point 504. This alternate support blanket 500 has a left side 501, a right side 502, a bottom side 507 and a front side 505. It has a large opening 503 that fits over the wire mesh cloth 113. It has an access opening 506 on the front side to access the interior of the head compartment. This alternate primary support blanket is completely open on one side that is fitted over the head compartment of the main wedge-shaped body 100 in the same fashion that a cover sheet is fitted over a mattress. It may have elastic rubber band or similar around the open side edges to keep this alternate primary support blanket tightly fitted over the head compartment and thus serves as the primary support of the infant to the main wedge-shaped body 100.

The invention claimed is:

1. An infant sleep aid device, said device comprising:

a wedge-shaped main body comprising a bottom surface and a planar top surface which is inclined with respect to said bottom surface;

a torso support section for partially supporting the torso of the infant on said wedge-shaped main body;

a head support section for supporting the head of the infant on said wedge-shaped main body;

a means of collection for receiving vomits of the infant while resting on said wedge-shaped main body;

a means of prevention for preventing the infant from suffocating on said wedge-shaped main body;

a first means of support for securing the infant in a prone position on said wedge-shaped main body; and a second means of support for securing the infant in a supine position on said wedge-shaped main body.

2. The infant sleep aid device of claim 1 wherein said head support section further comprises a front wall and two side walls.

3. The infant sleep aid device of claim 1 wherein said torso support section further comprises a core mattress made from a resilient material removably disposed in said torso support section.

4. The infant sleep aid device of claim 1 wherein said head support section for supporting the head of the infant on said wedge-shaped main body further comprises a wire mesh cloth removably disposed across at least a portion of said planar top surface and onto which the head of the infant may be disposed.

5. The infant sleep aid device of claim 4 wherein said wire mesh cloth further comprises an impermeable and non-cohesive fabric with mesh-like perforations.

6. The infant sleep aid device of claim 1 wherein said means of collection for receiving vomits of the infant while resting on said wedge-shaped main body further comprises a funnel that is removably fitted in said head support section.

7. The infant sleep aid device of claim 6 wherein said funnel further comprises an integral pipe at the bottom of the funnel and adapted to channel the vomits of the infant to a receiving container.

8. The infant sleep aid device of claim 1 wherein said means of prevention for preventing the infant from suffocating on said wedge-shaped main body further comprises ventilation openings in the head support section.

9. The infant sleep aid device of claim 6 wherein said funnel further comprises ventilation holes for providing maximum airflow to the head of the infant.

10. The infant sleep aid device of claim 1 wherein said first means of support for securing the infant in a prone position on said wedge-shaped main body further comprises a first main support blanket that is releasably attached to the sides of the wedge-shaped main body, a prone position support harness that receives the infant directly in said prone position and that is releasably attached to said first main support blanket, and a first alternate support blanket that is removably fitted over said head support section.

11. The infant sleep aid device of claim 10 wherein said prone position support harness is removably attached to the first alternate support blanket.

12. The infant sleep aid device of claim 1 wherein said second means of support for securing the infant in a supine position on said wedge-shaped main body further comprises a second main support blanket that is releasably attached to the sides of the wedge-shaped main body, a wrap-swaddle combination that receives the infant directly in said supine position and that is removably attached to said second main support blanket, and a second alternate support blanket that is removably fitted over said head support section.

13. The infant sleep aid device of claim 12 wherein said wrap-swaddle combination is removably attached to the second alternate support blanket.

* * * * *